US011396400B2

(12) United States Patent
Shiflett, Jr. et al.

(10) Patent No.: US 11,396,400 B2
(45) Date of Patent: Jul. 26, 2022

(54) BUCKET WITH EXTERNAL ORGANIZER

(71) Applicants: Ronald C. Shiflett, Jr., Midlothian, VA (US); Grant H. Caldwell, Midlothian, VA (US); Timothy J. Powell, Steinhatchee, FL (US); Kenneth D. Robertson, Midlothian, VA (US)

(72) Inventors: Ronald C. Shiflett, Jr., Midlothian, VA (US); Grant H. Caldwell, Midlothian, VA (US); Timothy J. Powell, Steinhatchee, FL (US); Kenneth D. Robertson, Midlothian, VA (US)

( * ) Notice: Subject to any disclaimer, the term of this patent is extended or adjusted under 35 U.S.C. 154(b) by 0 days.

(21) Appl. No.: 17/100,206

(22) Filed: Nov. 20, 2020

(65) Prior Publication Data

US 2021/0070502 A1 Mar. 11, 2021

Related U.S. Application Data

(63) Continuation-in-part of application No. 16/502,577, filed on Jul. 3, 2019, now abandoned.

(60) Provisional application No. 62/938,373, filed on Nov. 21, 2019.

(51) Int. Cl.
*B65D 25/20* (2006.01)

(52) U.S. Cl.
CPC ..... *B65D 25/20* (2013.01)

(58) Field of Classification Search
CPC ..... B65D 25/20; B65D 23/06; B65D 25/22; B65D 5/48002; B44D 3/12; B44D 3/121
USPC ..... 220/735, 729, 733, 694; 206/349, 216, 206/1.7, 373, 223, 371, 562, 564, 565
See application file for complete search history.

(56) References Cited

U.S. PATENT DOCUMENTS

| | | | | |
|---|---|---|---|---|
| 5,350,065 | A * | 9/1994 | Darrey | B25H 3/00 206/373 |
| 7,845,656 | B2 * | 12/2010 | Thompson | B62B 3/104 280/47.35 |
| 8,887,940 | B2 * | 11/2014 | Kiceniuk, Jr | B44D 3/126 220/495.02 |
| 2006/0157946 | A1 * | 7/2006 | Stuemke | B65F 1/14 280/79.5 |
| 2006/0214384 | A1 * | 9/2006 | Gwin | B62B 5/0083 280/79.5 |
| 2018/0028888 | A1 * | 2/2018 | Silva | A63B 63/083 |

* cited by examiner

*Primary Examiner* — Rafael A Ortiz
(74) *Attorney, Agent, or Firm* — Russell Manning; FisherBroyles, LLP

(57) ABSTRACT

An integrally formed bucket and external organizer is provided. A bucket is provided having a tubular sidewall with an open upper end and a closed bottom end. An integrally formed brim connects to an outside surface of the tubular sidewall proximate to the open upper end. The brim extends radially outward from the tubular sidewall to an external or exterior edge. The brim includes a plurality of apertures that extend though its surface (e.g., between an interior edge attached to the tubular sidewall and the exterior edge). Such apertures may support various items (e.g., tools, fishing gear, etc.).

12 Claims, 6 Drawing Sheets

BUCKET WITH EXTERNAL ORGANIZER

CROSS REFERENCE

The present application claims the benefit of the filing date of U.S. Provisional Patent No. 62/938,373 having a filing date of Nov. 21, 2019, the present application is also a continuation-in-part of U.S. patent application Ser. No. 16/502,577 having a filing date of Jul. 3, 2019, the entire contents of both of which are incorporated herein by reference.

FIELD

The present disclosure relates to a bucket device having an external organizer or brim that is configured to support one or more items (e.g., tools) relative to an exterior of the bucket. The design permits continued use of an interior of the bucket to hold, for example, liquids while supporting one or more items relative to the exterior of the bucket.

BACKGROUND

Bucket tool organizers or caddies are well known devices for transporting and storing tools, utensils, or other useful implements. Such devices typically include a bucket mounted fabric tool carrier having a shape that conforms generally to the surfaces of an empty bucket. A number of individual pockets or dividers arranged about both the interior and/or exterior portions of the container can be used to quickly store and organize variously sized objects for later access. Such designs include a fabric insert that drape over the top edge of the bucket such that tools may be arranged in pockets about both an interior periphery of the bucket and an exterior periphery of the bucket. Other designs include dividers and or trays configured for receipt within the interior of the bucket.

SUMMARY

The inventors have recognized that is often desirable to support items relative to an external surface of a bucket while permitting continued use of the interior of the bucket (e.g., to hold liquids) and/or to attach a lid to the bucket. While numerous bucket organizers exist, such organizers are typically based on the premise that the interior bucket will not be used to carry or otherwise hold liquids or other materials once the organizer is attached. Accordingly, provided herein is a bucket device having an integrally formed external brim that is configured to support one or more items (e.g., tools) relative to an exterior of the bucket.

In an aspect, an integrally formed bucket and external organizer is provided. That is, a bucket and external organizer or support brim may be integrally formed (e.g., in an injection molding process). In one arrangement, a bucket is provided having a tubular sidewall with an open upper end and a closed bottom end. A brim connects to an outside surface of the tubular sidewall proximate to the open upper end. The brim extends radially outward from the tubular sidewall to an external or exterior edge. That is, the brim may extend radially away from a centerline axis of the interior of the bucket. The brim extends around at least a portion of the periphery of the bucket. In an arrangement, the brim extends around less than half of the periphery of the bucket such that it does not interfere with the movement of a bail (e.g., handle) attached to opposing points on the outside surface of the tubular sidewall of the bucket. In another arrangement, the brim may extend around more than half or an even entirety of the periphery of the bucket. In such an arrangement, a flexible tensile handle (e.g., rope) may be used. In any arrangement, the brim includes a plurality of apertures that extend though its surface (e.g., between an interior edge attached to the tubular sidewall and the exterior edge). Such apertures may support various items (e.g., tools, fishing gear, etc.).

In an arrangement, the brim that may extend about a portion or all of the outside peripheral surface of the bucket. That is, a rim or brim attached to the outer sidewall or upper peripheral rim of the bucket extends radially outward from an interior edge attached to a sidewall (e.g., tubular sidewall) to an exterior edge. Stated otherwise, the brim cantilevers from the bucket sidewall. In an arrangement, an upper surface of the brim is substantially transverse to a centerline axis of an interior of the bucket. In another arrangement, an upper surface of the brim is a planar surface.

The plurality of apertures form openings through the brim between its top and bottom surfaces. The apertures may have differing sizes and shapes. In an arrangement, at least one of the apertures may be a large aperture having a cross-dimension (e.g., diameter) that is at least twenty or thirty percent (20% or 30%) of a radius of an interior of the bucket. In a further arrangement, the large aperture may have cross-dimension (e.g., diameter) that is at least fifty percent (50%) of a radius of the bucket. In such an arrangement, one or more of the large apertures may be sized to receive water bottles, other drink containers, lanterns etc. In a further arrangement, one or more of the apertures may have an insert (e.g., mesh, webbing etc.) that extends below the aperture. Such an insert may be a flexible bag having an open mouth attached about the periphery of the aperture.

The bucket device may be formed of any material including, without limitation, polymers (e.g., plastics) metals and composites. In an arrangement, the bucket and brim are integrally formed in an injection molding process. To provide further rigidity for the brim (which typically cantilevers from the bucket sidewall), one or more braces may extend between a bottom surface of the brim and an outside surface of the bucket sidewall.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Bucket organizers are typically fabric inserts that drape over the top peripheral edge of a bucket to provide various pockets on the exterior and/or interior periphery of the bucket. Such organizes are impractical for buckets that will continue being used to hold liquids or buckets that require a lid in a closed position. Accordingly, provided herein is a combined bucket and external organizer (e.g., "bucket device" or "device"), which is attached to an exterior surface (e.g., sidewall) of a bucket, that allows for supporting items on an exterior of the bucket. The external organizer may be entirely free of connection or intrusion into an interior of the bucket permitting continued use of an interior of the bucket to hold liquids or other materials and/or to allow a lid to attach to the bucket while using the external organizer.

Figure 1:
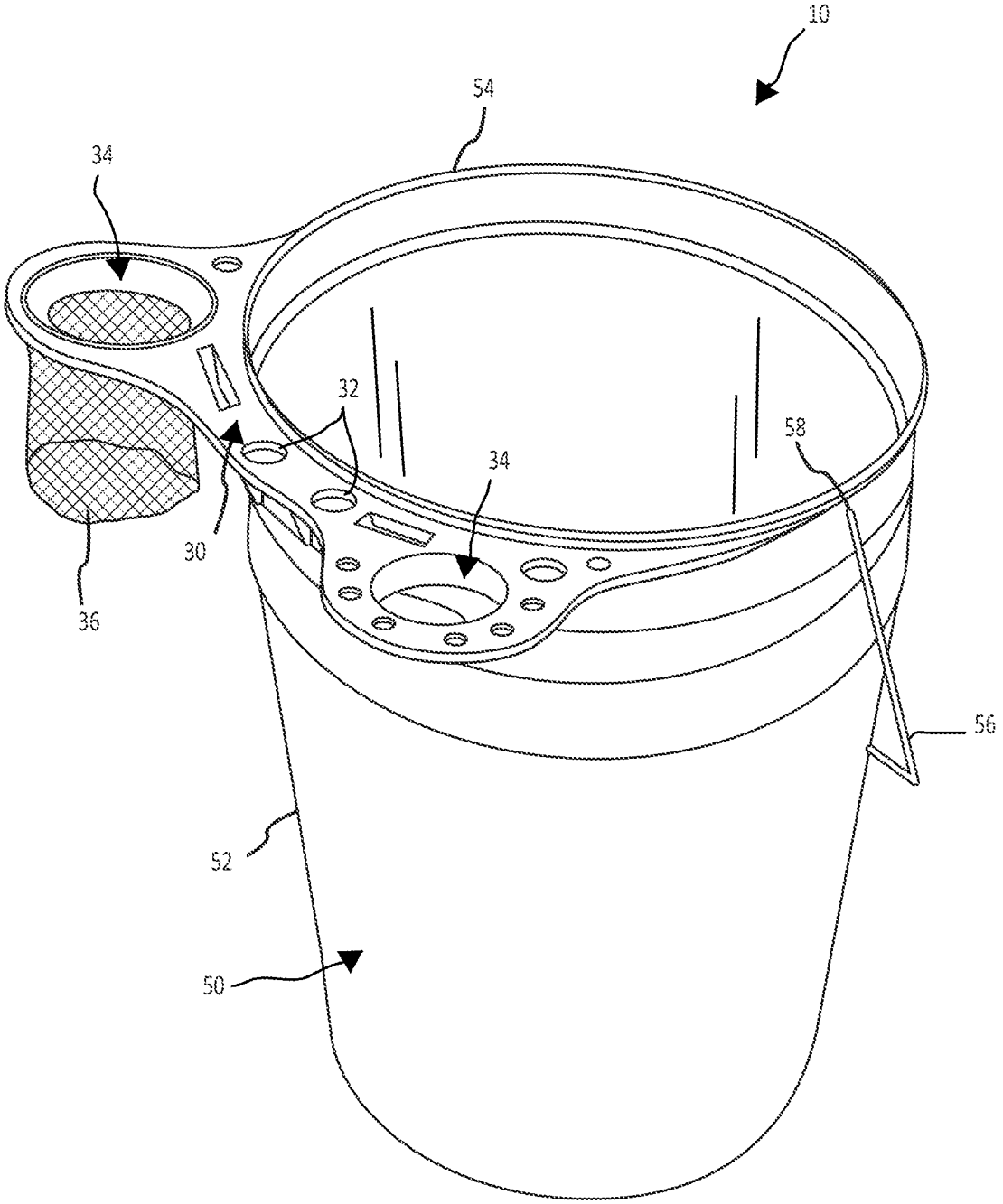
FIG. 1 Illustrates a first embodiment of a bucket device.

FIG. 1 illustrates one embodiment of a bucket device in accordance with the present disclosure where an external organizer or brim is integrally formed with an exterior of a bucket 50 to allow for supporting items on an exterior of the bucket. As will be appreciated, many buckets are produced in an injection molding process. By modifying a mold utilized to produce an injection molded bucket, a resulting bucket may be made with an integrally formed brim extending around a portion of its outside surface.

As shown in FIG. 1 illustrates a bucket device 10 where a bucket 50 and an external organizer or brim 30 are integrally formed. In this embodiment, the brim 30 extends outward from a tubular sidewall 52 of the bucket 50 from a location proximate to the open upper end/top edge or rim 54 of the bucket 50. The brim 30 is typically disposed a spaced distance below the top rim 54 to permit attachment of a lid to the bucket (not shown in FIG. 1). The brim 30 may include a plurality of apertures 32 and/or large apertures 34, which may include a fabric insert 36. Further, bracing may extend between the bottom surface of the brim 30 and an outside surface of the tubular sidewall 54. In the illustrated embodiment, the integral brim 30 extends around on-half or less of the periphery of the bucket 50. Along these lines, it will be noted that many buckets include a bail 56 (e.g., handle) that is pivotally connected to first and second opposing points 58 (only one shown) on an outside surface of the bucket 50. The bail 56 is generally configured to rest against the side of the bucket 50 when not in use and pivot to a position above the bucket when utilized to carry or lift the bucket. Accordingly, by limiting the length of the brim 30 to one-half or less of a distance around the periphery of the bucket 50 and/or forming the brim 30 between the connection points 58 of the bail 56, the radially extending brim 30 does not interfere with the movement of the bail 56 relative to one side of the bucket 50.

Figure 2A:
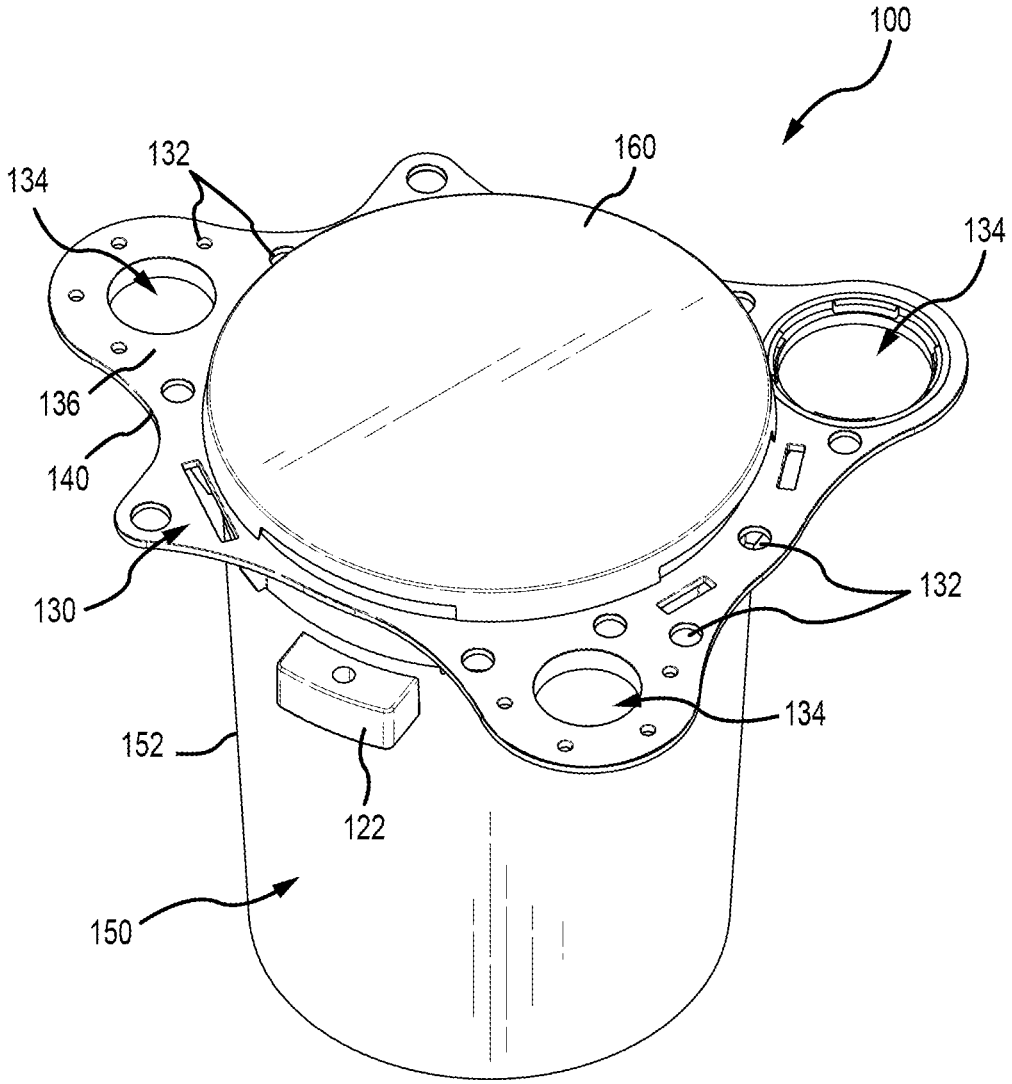
FIG. 2A illustrates a top perspective view of a second embodiment of a bucket device with a lid.
Figure 2B:
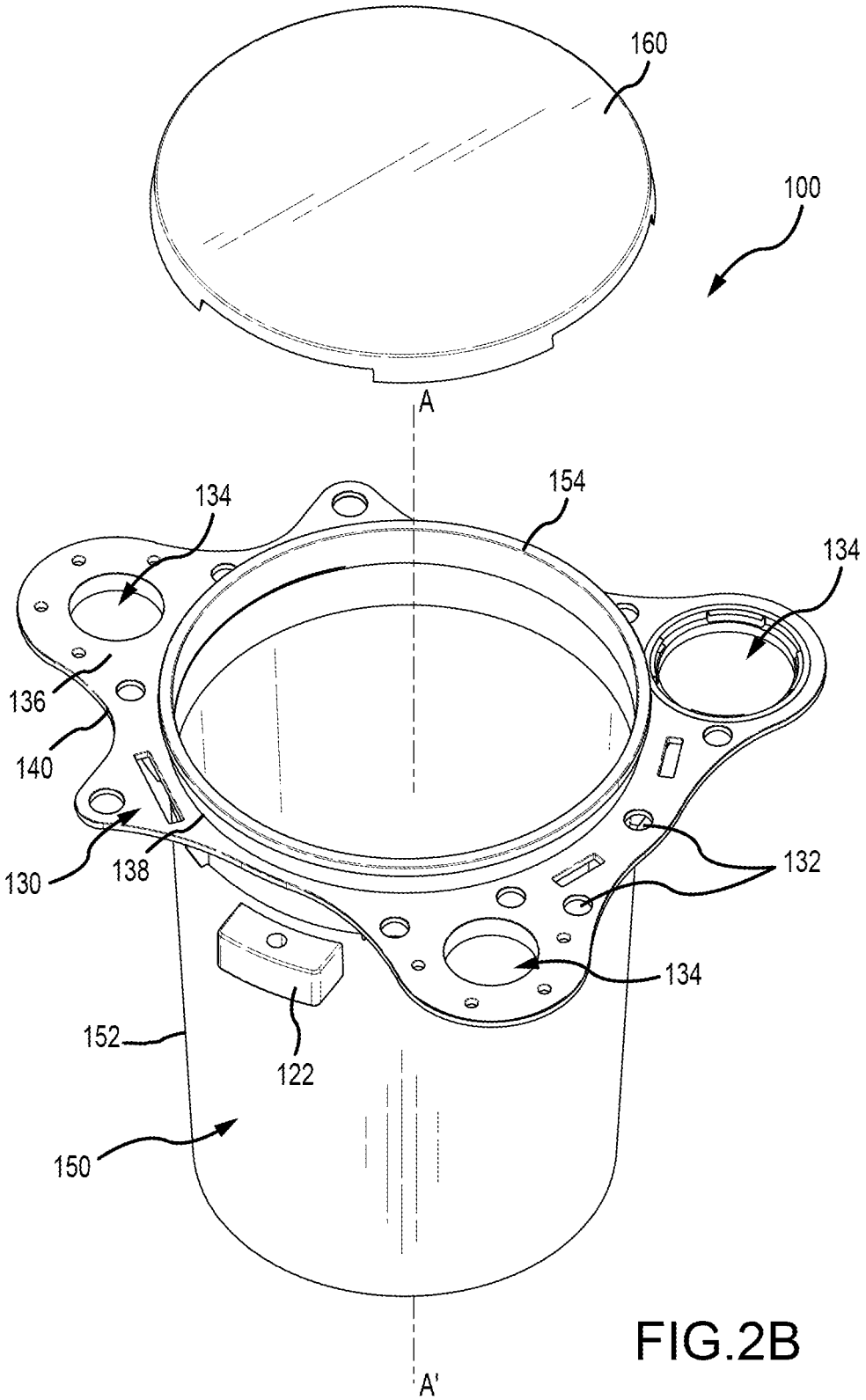
FIG. 2B illustrates a top perspective view of the second embodiment of the bucket device with the lid removed.
Figure 2C:
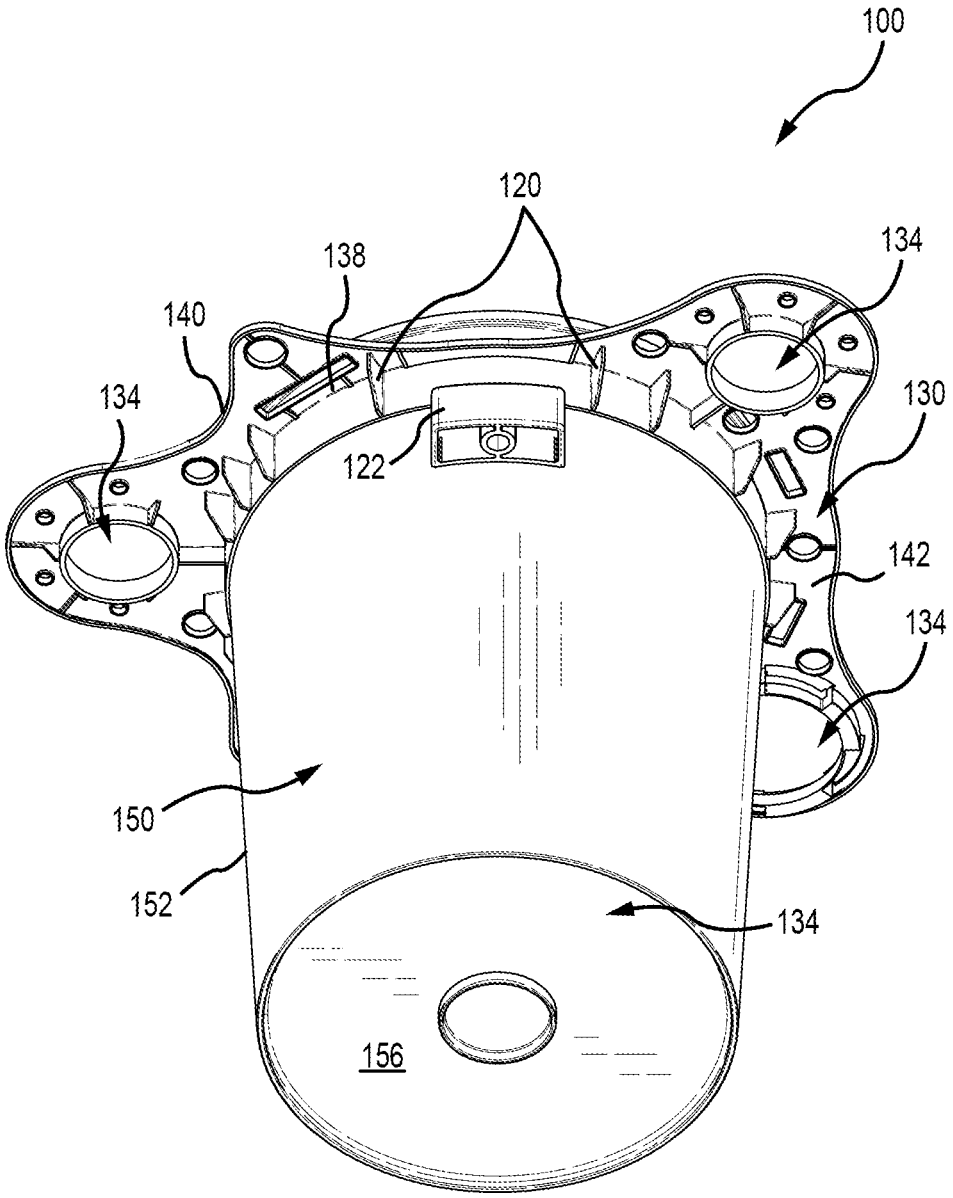
FIG. 2C illustrates a bottom perspective view of the second embodiment of the bucket device.
Figure 3:
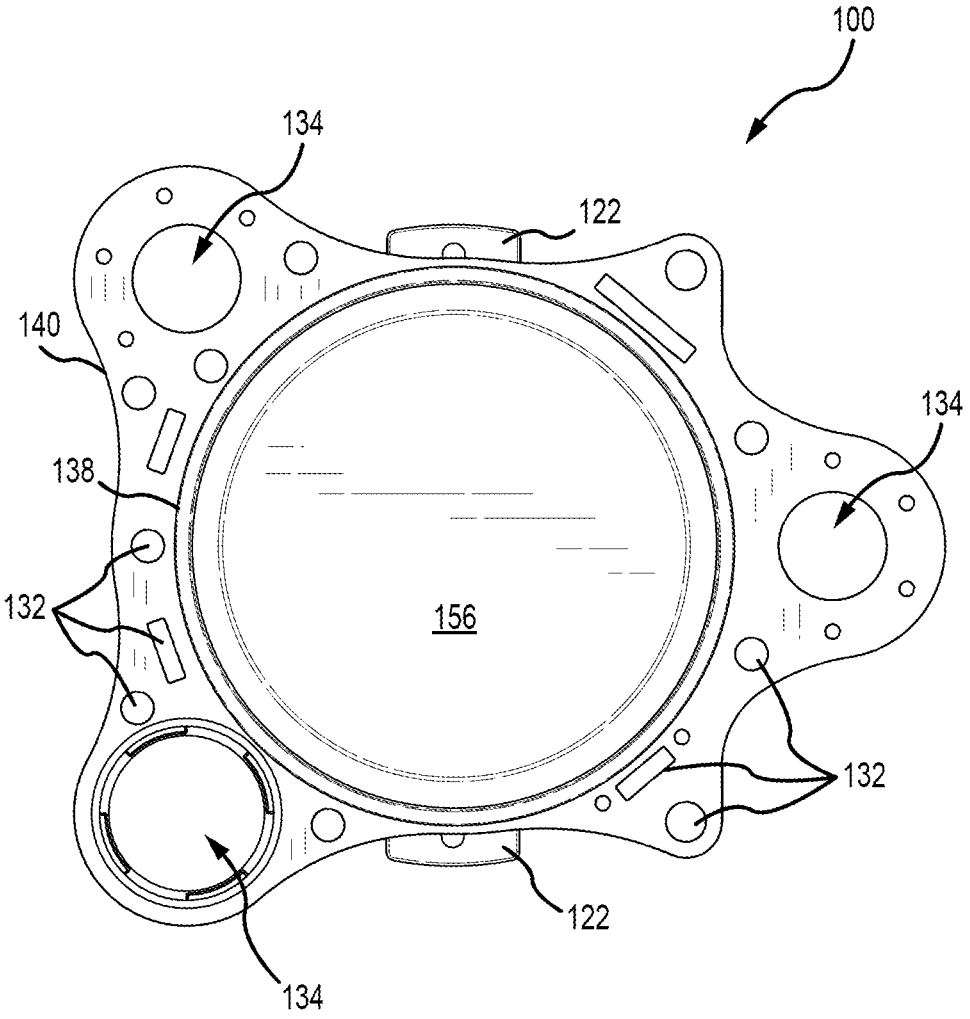
FIG. 3 illustrates a top plan view of the second embodiment of the bucket device.
Figure 4:
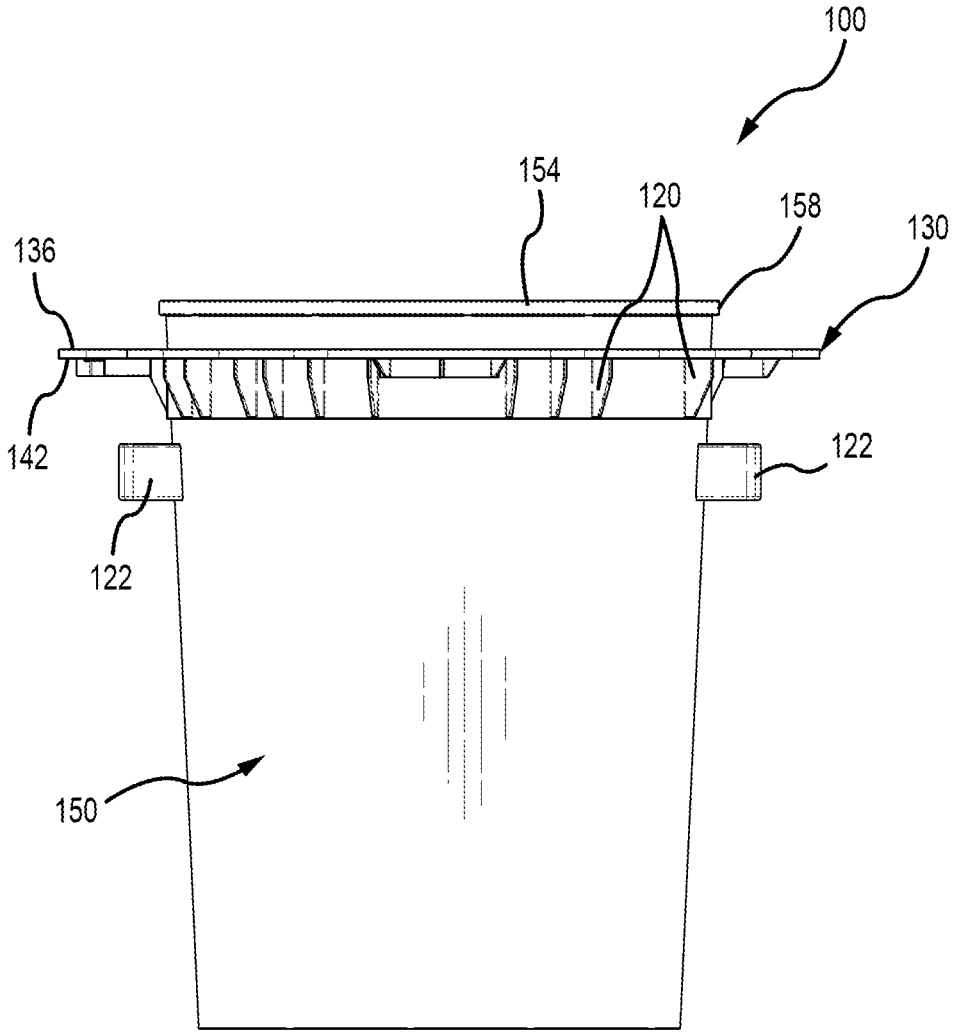
FIG. 4 illustrates a side view of the bucket device.

FIGS. 2A-2C, 3 and 4 illustrate another embodiment of a bucket device 100 in accordance with the present disclosure. More specifically, FIG. 2A illustrates a top perspective view of the device 100 with a lid 160 attached to the device 100, FIG. 2B illustrates the top perspective view of the device 100 with the lid 160 removed, FIG. 2C illustrates a bottom perspective view of the device, FIG. 3 illustrates a top view of the device 100 with the lid removed, and FIG. 4 illustrates a side view of the device 100 with the lid 160 attached. The device 100 includes a bucket 150 having a tubular sidewall 152 with on open top end and a closed bottom end 156. A brim 130, which is integrally formed with the bucket 150, extends around the entire periphery of the sidewall 152 of the bucket 150. More specifically, the brim 130 extends radially outward relative to a centerline axis A-A' (See FIG. 2B) of the tubular sidewall 152, from a location proximate to the open upper end or top edge 154 of the bucket 150. In the illustrated embodiment, the brim 130 is attached to an outer surface of the sidewall 152 a short distance below the top edge 154 of the bucket 150 to permit attaching the lid 160 to the bucket 150. That is, a top edge 154 of the bucket 150 extends above a top surface 136 of the brim 130 around the periphery of the bucket 152. The top edge 154 may further include an annular rim or lip 158 that extends slightly outward from an outside surface of the sidewall 153. Such an annular rim 158 is utilized to attach the lid 160 to the bucket.

The brim 130 includes a plurality of apertures 132 and may include one or more large apertures 134, which may include a fabric insert (not shown). Further, bracing 120 may extend between the bottom surface of the brim 130 and an outside surface of the tubular sidewall 152. In the illustrated embodiment, the brim 130 extends radially outward substantially transverse to the outer surface of the bucket sidewall 152. In an embodiment, the generally planar top surface 136 of the brim 130 is substantially perpendicular to the centerline axis A-A' of the bucket 150 about an outer periphery of the sidewall 152. In any embodiment, the brim 130 forms a cantilevered surface around the periphery of the bucket 150. In this regard, an interior edge 138 (e.g., peripheral edge) of the brim 130 is connected to and/or defined by the outside surface of the sidewall 152. The brim 130 extends from the interior edge 138 to an exterior edge 140 (e.g., peripheral edge) forming a support surface that is substantially transverse to the sidewall. As illustrated, the width of the brim (e.g., between the interior edge 138 and exterior edge 140 at any radial position relative to the centerline axis) may vary around the periphery of the brim 130.

As previously noted, a plurality of apertures 132 are formed through the surface of the brim 130 between its interior and exterior edges. The size, shape, number and location of these apertures 132 may vary and the illustrated apertures 132 are presented by way of example only. These apertures 132 define receptacles for holding various items relative to the outside surface of the bucket. In the present embodiment, some of the apertures are large apertures 134 having increased cross-dimensions (e.g., diameters) and which are formed in corresponding projections or wider portions of the brim 130. By way of example, a large apertures 134 may have a cross-dimension that allows the large aperture to receive, for example, a drink container/water bottle or other larger item. In an embodiment, the cross-dimension (e.g., diameter) of the large apertures may be at least twenty percent (20%) of the radius of the bucket sidewall 152. In further embodiments, the cross-dimension may be 30%, 40%, 50% or even 60% of the radius of the sidewall 152.

To facilitate use of the large aperture(s) to hold various items, one or more of the large apertures may include an insert. As best illustrated in FIG. 1, one embodiment of such an insert is a bag 36 (e.g., mesh bag) having its opening/mouth attached about the periphery of one of the large apertures 34 with a closed end of the bag extending below a lower surface of the brim 30. When attached to the periphery of the aperture 34, an interior of the bag is accessible through the top surface of the brim. As will be appreciated, the insert allows the large aperture 34 hold items such a water bottle or, for example loose items. The insert may, in an embodiment, fixedly attach to the large aperture. In another embodiment, the insert is removably connected to the large aperture. Though illustrated with the embodiment of FIG. 1, it will be appreciated that device of FIGS. 2A-4 may likewise incorporate such inserts.

In the illustrated embodiment of FIGS. 2A-4, various braces 120 are formed between the outer surface of the sidewall 152 and a bottom surface 142 of the brim 130. The braces 120 provide rigidity for the brim 130, which cantilevers away from the sidewall. That is, the braces 120 provide structural rigidity that allows the brim 130 to support various items relative to an outside surface of the bucket 150 without significant deflection.

The incorporation of a brim 130 that extends about the entire periphery of the bucket 150 typically prevent the use of a bail handle that rests against the side of the bucket when not in use and pivots to a position above the bucket when needed. To provide a means for carrying the bucket device, the illustrated embodiment includes two extrusions or blocks 122 formed on opposing outside surfaces of the sidewall 152. Each block 22 is configured to receive a tensile element (e.g., a rope) that may be used as a handle for the bucket. In this regard, the block may include an aperture through which a rope may pass. That is, a rope may pass through the apertures of the two blocks and be knotted below each block to form a handle for the bucket device 100. The blocks 122 may be integrally formed with the bucket and brim.

In an embodiment, the body of the device is integrally formed. In a specific embodiment, the device is made from a polymeric material that may be formed in an injection molding process. However, it will be appreciated that other materials and means of forming the device are considered within the scope of the present disclosure. When utilizing a polymeric material, it is generally desirable that the material provide sufficient resistance to bending such that the brim is minimally deflected under a load of a few pounds. In an embodiment, it is desirable that a stiffness of the polymeric material comply with ASTM D-790 and/or ISO 178, which each specify guidelines for determining the flexural properties of rigid and semi-rigid plastics under defined conditions. In an embodiment, the material chosen may have at least a 100,000 PSI under ASTM D-790 and more preferably at least 200,000 PIS under ASTM D-790 to provide sufficient stiffness. Further, the thickness and material selected may be altered to achieve desired deflection under load. In one embodiment, a thickness of an injected molded sidewall and brim is at least 0.08 inches. In a further embodiment, the thickness is at least 0.10 for the sidewall and at least 0.16 for the brim. In one embodiment, the material forming the tubular sidewall and brim has a specific gravity of less than one such that the device will float. In one particular embodiment, high density polyethylene (HDPE) was selected based on all of the above noted factors.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A bucket device comprising:

a tubular sidewall having an open upper end and a closed lower end defining an interior of the bucket device;

first and second handle support blocks integrally formed on opposing positions on an outside surface of the tubular sidewall, each handle support block including an aperture extending through a top surface extending transversely away from the tubular sidewall;

a brim attached to and integrally formed with the outside surface of the tubular sidewall proximate to the open upper end of the tubular sidewall and extending transversely away from the tubular sidewall to an exterior edge, the brim extending around the periphery of the tubular sidewall, wherein the brim includes:

a plurality of apertures that extend through the brim; and a width, between an interior edge attached to the tubular sidewall and the exterior edge, that varies around the periphery of the tubular sidewall, wherein the brim has a first and second narrow sections disposed above the first and second handle support blocks, respectively, wherein a width of each narrow section at least partially exposes the aperture in the top surface of the support block; and, a tensile element extending between the first and second handle support blocks over the open upper end of the tubular sidewall and through the aperture in each support block.

2. The device of claim 1, wherein one of the plurality of apertures is a large aperture having a cross-dimension that is at least twenty percent (20%) of an interior radius of the tubular sidewall.

3. The device of claim 2, the large an aperture has a cross-dimension that is at least fifty percent (50%) of the interior radius of the tubular sidewall.

4. The device of claim 2, wherein the large aperture further comprises:

a flexible bag having an open end connected about a periphery of the large aperture, wherein a closed end of the bag extends below a bottom surface of the brim.

5. The device of claim 1, wherein a top surface of the brim is planar.

6. The device of claim 1, further comprising at least a first brace extending from a bottom surface of the brim to an outside surface of the tubular sidewall.

7. The device of claim 6, wherein the tubular sidewall and the brim are formed of a polymeric material.

8. The device of claim 7, wherein a specific gravity of the polymeric material is less than one.

9. The device of claim 8, wherein the polymeric material has a stiffness of at least 200,000 psi per ASTM D-790.

10. The device of claim 7, wherein the tubular sidewall and the brim are injection molded.

11. The device of claim 7, wherein the tubular sidewall and the brim have a thickness of at least 0.08 inches.

12. The device of claim 1, wherein each handle support block further comprises:

an outer wall extending from an outer edge of the top surface, first and second sidewalls extending from first and second ends, respectively, of the outer wall to the outer surface of the tubular sidewall, and an open bottom surface, wherein the top surface and sidewalls define a hollow interior of the block.

* * * * *